US007789677B2

(12) United States Patent
Yang et al.

(10) Patent No.: US 7,789,677 B2
(45) Date of Patent: Sep. 7, 2010

(54) ELECTRICAL CONNECTOR HAVING LOW BOARD MOUNTING PROFILE

(75) Inventors: Sheng-Ho Yang, Tu-cheng (TW); Chun-Chieh Yang, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/319,479

(22) Filed: Jan. 7, 2009

(65) Prior Publication Data

US 2010/0173533 A1 Jul. 8, 2010

(30) Foreign Application Priority Data

Jan. 7, 2008 (TW) ..... 097200339

(51) Int. Cl.
*H01R 12/00* (2006.01)

(52) U.S. Cl. ..... 439/83; 439/564

(58) Field of Classification Search ..... 439/733.1, 439/374, 83, 78, 562, 564, 566
See application file for complete search history.

(56) References Cited

U.S. PATENT DOCUMENTS 5,197,891 A * 3/1993 Tanigawa et al. ..... 439/83
5,813,871 A * 9/1998 Grabbe et al. ..... 439/108
6,004,140 A * 12/1999 Kato et al. ..... 439/65
6,648,676 B1 * 11/2003 Lee ..... 439/499
6,743,053 B2 * 6/2004 Wu ..... 439/634
6,896,556 B1 * 5/2005 Wu ..... 439/638
6,942,524 B2 * 9/2005 Wu ..... 439/637
7,435,138 B2 * 10/2008 Liu et al. ..... 439/607.01
7,452,238 B1 * 11/2008 Wu ..... 439/579
7,467,969 B2 * 12/2008 Liu et al. ..... 439/493
7,470,150 B2 * 12/2008 Kuo et al. ..... 439/607.41
2002/0111064 A1 * 8/2002 Kohno ..... 439/547
2004/0029428 A1 * 2/2004 Wu ..... 439/357

* cited by examiner

*Primary Examiner*—Neil Abrams
*Assistant Examiner*—Phuong Nguyen
(74) *Attorney, Agent, or Firm*—Wei Te Chung; Andrew C. Cheng; Ming Chieh Chang

(57) ABSTRACT

An electrical connector (1), which is adapted for mounting to a circuit board (5), has a mounting foot (21) with a top mounting surface (211), an elongated base portion (23) protruded outwardly from said top mounting surface (211) and fitting members (4) set on the top mounting surface (211). In assembly, the top mounting surface (211) is face to the back of the circuit board (5), and the whole mounting foot (21) is left below the circuit board (5), which can minimize the mounting profile of the connector (1) effectively.

9 Claims, 6 Drawing Sheets

ELECTRICAL CONNECTOR HAVING LOW BOARD MOUNTING PROFILE

BACKGROUND OF THE INVENTION

1. Field of the Invention

The present invention relates to an electrical connector, and more particularly, to an electrical connector mounted from a bottom surface of a printed circuit board so as to reduce the overall height exposed above a top surface of the same.

2. Description of Related Art

In the last decade, electrical connectors are widely used in electronic devices, such as notebooks. As the time goes by, the popularity of these devices has risen as the cost and the sizes of the devices have diminished, and low profile is naturally required for electrical connector to meet the reduced sizes of the equipments said above.

T.W. Pat. No. 510588 issued on Nov. 11, 2002 discloses a related board end connector. Said electrical connector includes a base portion, a number of contacts received in the base portion, a guiding block on each one of two opposite side faces of the base portion for guiding the connector to mate with a mating connector, a pair of retention portions outwardly extending from the back face of the base portion and a pair of board locks fixed to the retention portions for attaching the connector to the circuit board. As mentioned above, retention portions are extending a certain distance beyond the back face to provide a base for retaining corresponding board locks, the base portion and the retention portions are mounting above the circuit board in a certain height.

U.S. Pat. No. 6,331,122 B1 issued to Wu on Dec. 18, 2001 discloses another electrical connector. Said electrical connector also provides a guiding block on each one of two opposite side faces of the base portion and the rear ends of said guiding blocks are cut to leave a space for forming retention portions. With the retention portions engaged in the height of base portion, board mounting profile can be minimized accordingly. However, the depth of the base portion usually defined by interface standard, asking for lower mounting profile faces more difficulty.

Hence, an improved electrical connector having low board mounting profile is desired to improve the disadvantages of the related arts.

SUMMARY OF THE INVENTION

Accordingly, the object of the present invention is to provide an electrical connector having low board mounting profile.

In order to achieve the object set forth, an electrical connector, which is adapted for mounting to a circuit board, has a mounting foot with a top mounting surface, a elongated base portion protruded outwardly from said top mounting surface and two fitting members set on the top mounting surface. In assembly, the top mounting surface is face to the bottom surface of the circuit board, and the whole mounting foot is left below the circuit board, which can minimize the mounting profile of the connector effectively.

Other objects, advantages and novel features of the invention will become more apparent from the following detailed description when taken in conjunction with the accompanying drawings.

DETAILED DESCRIPTION OF THE INVENTION

Figure 1:
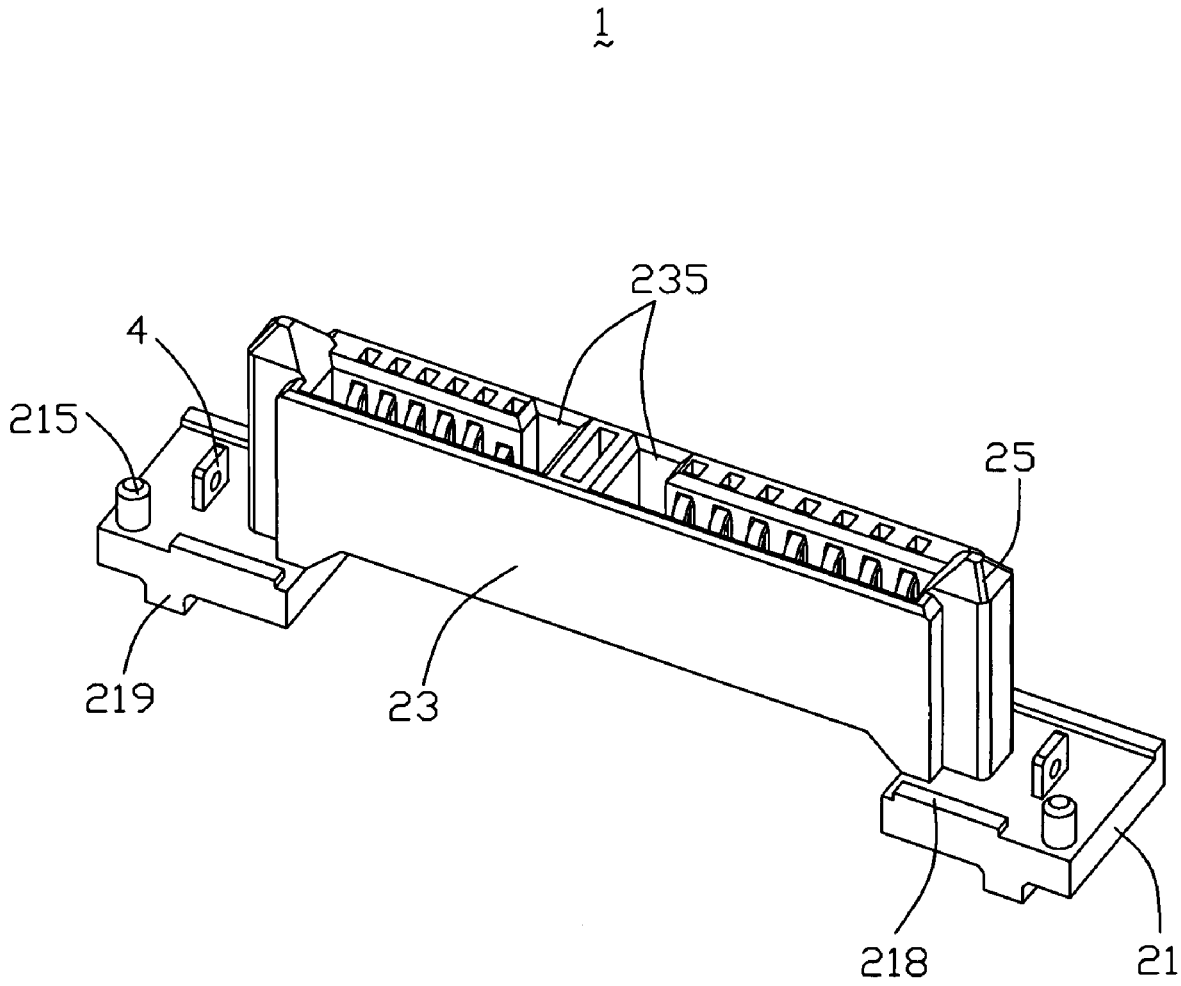
FIG. 1 is an assembled, perspective view of the electrical connector of an embodiment of the present invention.

Reference will now be made in detail to the preferred embodiment of the present invention.

Referring to FIGS. 1-6, an electrical connector 1 for mounting on a circuit board 5 in accordance with the embodiment of the present invention comprises an insulated housing 2, a plurality of terminals 3 received in said insulated housing 2, and two fitting members 4 assembled onto the insulated housing 1.

Figure 2:
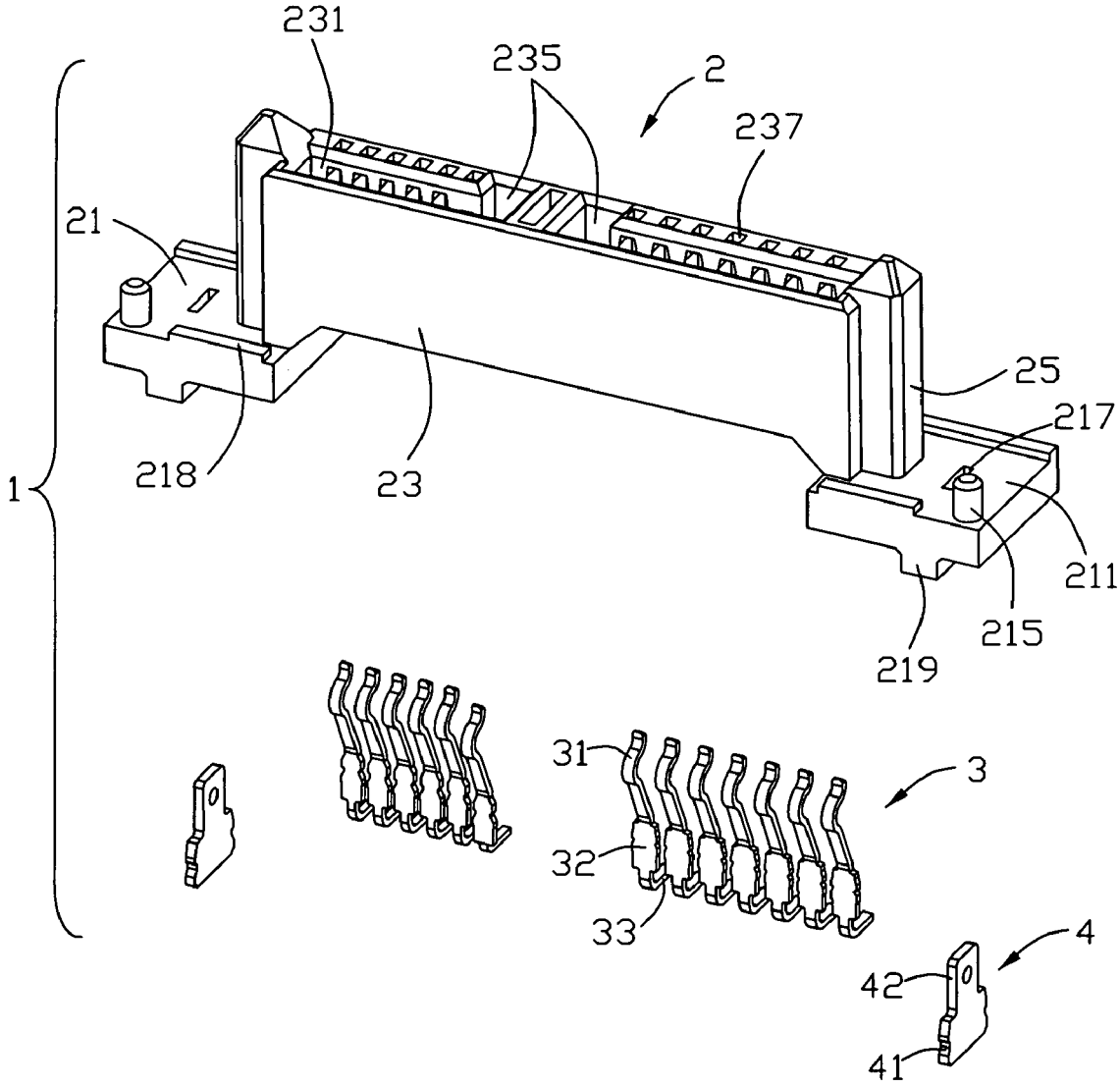
FIG. 2 is an exploded, perspective view of the electrical connector as shown in FIG. 1.
Figure 3:
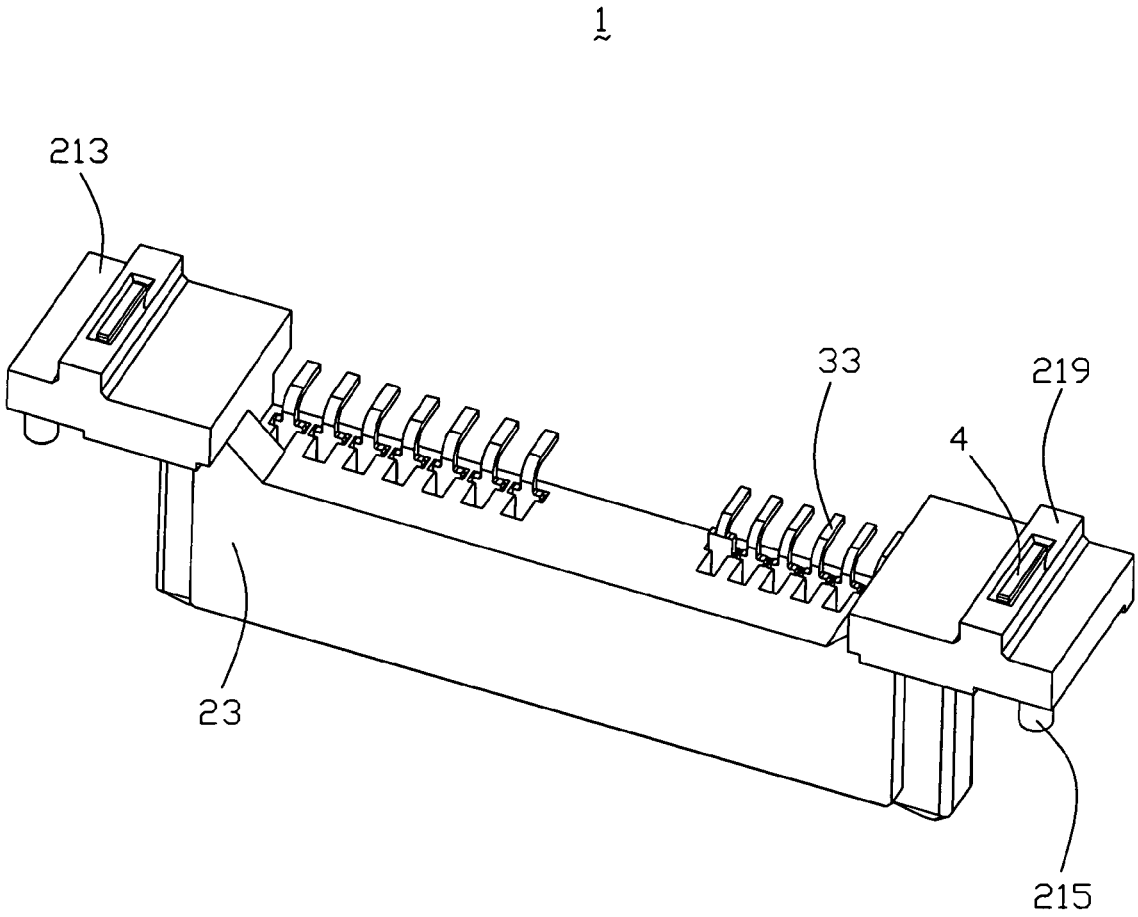
FIG. 3 is another assembled, perspective view of the electrical connector as shown in FIG. 1.

Referring to FIGS. 1-3, a mounting foot 21 is formed on said insulated housing 2, the mounting foot 21 engages a top mounting surface 211 for mounting said electrical connector 1 to a circuit board 5 and a back surface 213 opposite and parallel to the top mounting surface 211. An elongated base portion 23 with a mating head and a bottom-end opposite to the mating head is protruded outwardly from said top mounting surface 211, and two L-shaped mating slots 235 are hollowed on the base portion 23 vertical to the top mounting surface 211. Said electrical connector 1 comprises a pair of guiding blocks 25 protruded from the mounting foot 21 and located above the base portion 23, which are parallel to the base portion 23 and join with elongated two ends of the base portion 23. Said mounting foot 21 further defines two slits 217, and each of the fitting members 4 have an engaging section 41 retained in the slit 217 and a fitting section 42 for engaging the circuit board 5.

Still referring to FIGS. 1-3, said terminals 3 are inserted into said insulated housing from the bottom-end to the mating head and each of them comprises a elastic contact section 31 set in the mating slot 235, a mounting section 33 standing in parallel with the mounting face 211 and a securing section 32 interconnecting the contact section 31 and the mounting section 33. A plurality of terminal channels 237 are formed in the base portion 23 and said each terminal 3 is fixed to the terminal channel 237 by its securing section 32.

Figure 4:
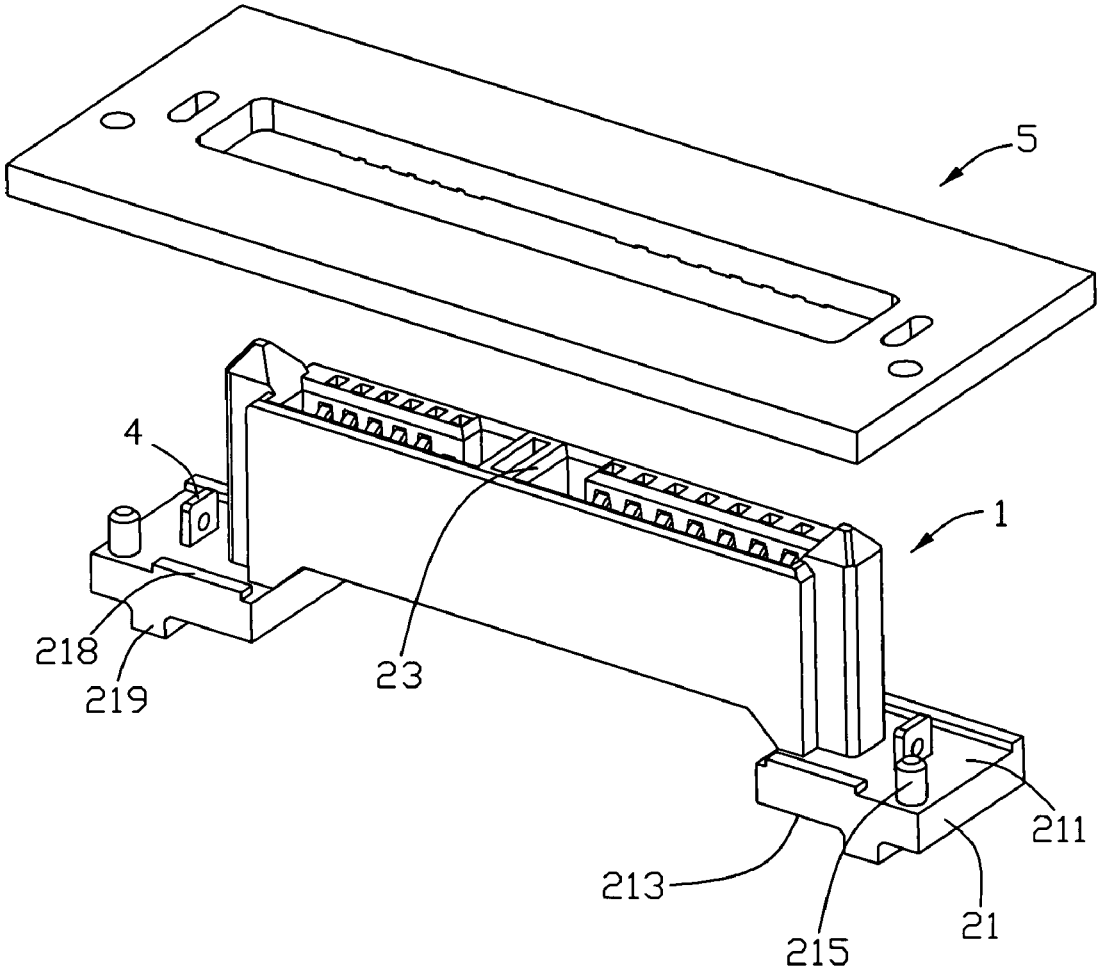
FIG. 4 is an assembled view of the electrical connector as shown in FIG. 1 before mounted to a circuit board.
Figure 5:
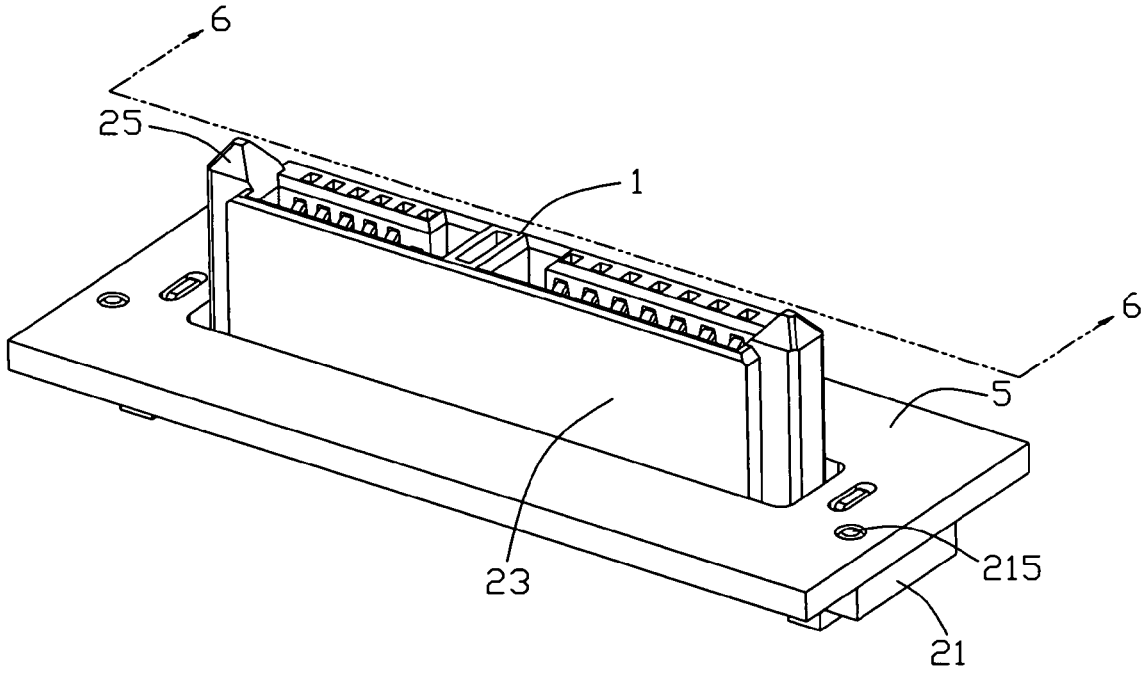
FIG. 5 is an assembled view of the electrical connector as shown in FIG. 1 after mounted to a circuit board.
Figure 6:
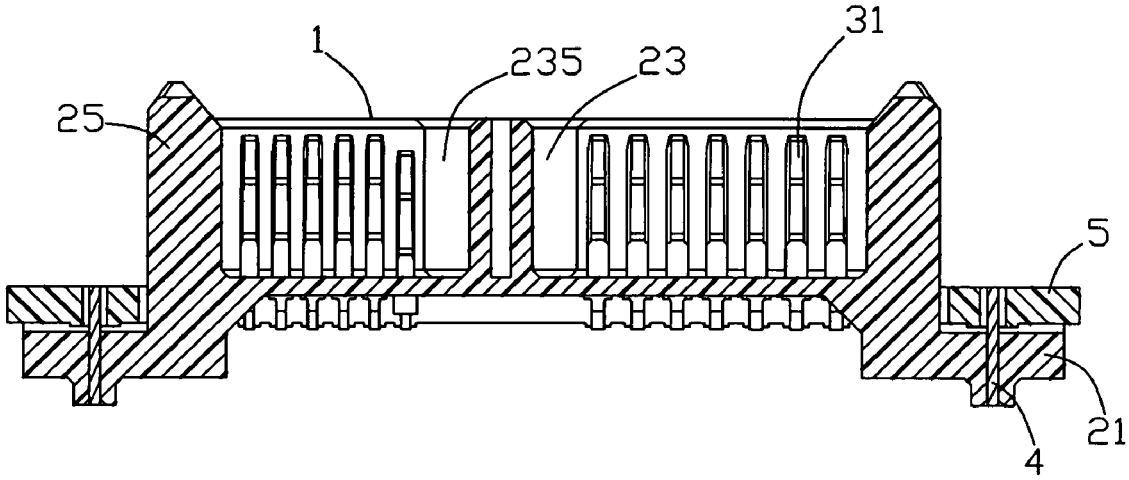
FIG. 6 is a cross-section view taken along line 6-6 of FIG. 5.

Referring to FIGS. 4-6, in assembly, said electrical connector 1 is mounting from the bottom surface of the circuit board 5, and contact section 31 of each terminal 3 is electrically connected to the bottom surface of the circuit board 5. Two posts 215 are formed on the top mounting face 211 in different sizes for keying and positioning the electrical connector 1. The top mounting surface 211 is face to the bottom surface of the circuit board 5, while the base portion 23 is going through the circuit board 5 and extending the front of said circuit board 5. and two fitting members 4 made by metal piece are assembled to the mounting foot 21 through the back surface 213 and extending out of the top mounting surface 211. Some protrusions 218 are formed on the mounting face 211 to leave an intervening space around the fitting member 4 to avoid floating of electrical connector 1 while welding. Said electrical connector 1 further engages two supporting portions 219 protruded on said back surface 213 to hold the fitting members 4 firmly and also can provide a touch on the back panel (not shown) under the circuit board 5 to engage the connector 1 well. In this way, the whole mounting foot 21 is assembled under the circuit board 5 and part of the base portion 23 is held in the circuit board 5. all the above can not only reduce the overall height exposed above a top surface, but also enhance the working performance of connector 1.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulated housing having an elongated base portion with a mating head and a bottom-end opposite to the mating head;

a mounting foot formed on the bottom-end, said mounting foot engaging a top mounting surface for mounting said electrical connector to a circuit board;

a metal fitting member set on the top mounting surface of the mounting foot; and a plurality of terminals inserted into said insulated housing from the bottom-end to the mating head;

a protrusion is formed on the top mounting face to leave an intervening space around the metal fitting member to avoid floating of the connector while it is welding;

a pair of guiding blocks parallel to the base portion and join with elongated two ends of the base portion, the top end of each guiding block is located above the mating head;

a mating slot is hollowed on the base portion vertical to the top mounting surface, and said mating slot is L-shaped;

the mounting foot defines a slit, and wherein the metal fitting member has an engaging section retained in the slit and a fitting section for engaging the circuit board;

said metal fitting member is assembled to the mounting foot through the back surface and extending from the top mounting surface;

said mounting foot defines a back surface opposite and parallel to the top mounting surface, some supporting portions are extending from the back surface at a boundary of the mounting foot;

two molding posts extending from the mounting surface in different size for keying and positioning the connector.

2. The electrical connector as claimed in claim 1, wherein the mounting foot is assembled under the circuit board.

3. The electrical connector as claimed in claim 1, wherein said contact section of the terminal is electrically connected to the bottom surface of the circuit board.

4. The electrical connector as claimed in claim 1, wherein a part of the base portion is held in the circuit board.

5. The electrical connector as claimed in claim 1, wherein each of the terminals comprises an elastic contact section in the mating slot.

6. The electrical connector as claimed in claim 5, wherein the base portion being going through the circuit board and extending to the front of the circuit board.

7. The electrical connector as claimed in claim 5, wherein said electrical connector further comprises each of terminals comprises a mounting section standing in parallel with the mounting top surface and a securing section interconnecting the contact section and the mounting section.

8. The electrical connector as claimed in claim 7, wherein a plurality of terminal channels are formed in the base portion and said each terminal is fixed to the terminal channel by its securing section.

9. The electrical connector as claimed in claim 3, wherein the support portions are abut on the back panel under the printed circuit board.

* * * * *